US009924789B2

(12) United States Patent
Session

(10) Patent No.: US 9,924,789 B2
(45) Date of Patent: Mar. 27, 2018

(54) HYDRO TOOTHBRUSH

(71) Applicant: George Ray Session, Spartanburg, SC (US)

(72) Inventor: George Ray Session, Spartanburg, SC (US)

( * ) Notice: Subject to any disclaimer, the term of this patent is extended or adjusted under 35 U.S.C. 154(b) by 0 days.

(21) Appl. No.: 15/369,169

(22) Filed: Dec. 5, 2016

(65) Prior Publication Data

US 2017/0156485 A1 Jun. 8, 2017

Related U.S. Application Data

(60) Provisional application No. 62/263,155, filed on Dec. 4, 2015.

(51) Int. Cl.
*A46B 11/06* (2006.01)
*A46B 9/04* (2006.01)

(52) U.S. Cl.
CPC ..... *A46B 11/063* (2013.01); *A46B 9/04* (2013.01); *A46B 2200/1066* (2013.01)

(58) Field of Classification Search
CPC combination set(s) only.
See application file for complete search history.

(56) References Cited

U.S. PATENT DOCUMENTS 1,097,122 A * 5/1914 Engstrom ..... A46B 11/063 15/202
3,610,234 A * 10/1971 Oates ..... A46B 11/063 401/289
3,869,746 A * 3/1975 Man-king ..... A61C 17/38 15/29
5,500,973 A * 3/1996 Phelan ..... A46B 11/063 15/29
6,067,684 A * 5/2000 Kweon ..... A46B 7/04 15/167.1
7,614,107 B2 * 11/2009 Cobabe ..... A46B 5/0075 15/22.1
8,801,316 B1 * 8/2014 Abedini ..... A46B 11/063 401/16

* cited by examiner

*Primary Examiner* — David Walczak

(57) ABSTRACT

A water propulsion toothbrush assembly for rinsing and cleaning a user's mouth by urging streams of water therethrough to remove plaque and food debris on and between teeth as well as below the gum line during brushing is provided. The toothbrush assembly includes a handle connected to a head, wherein the head provides a plurality of outlet apertures nested between conventional and novel soft bristles along the brush surface thereof. The plurality of outlet apertures is fluidly connected to a water source by way of veins extending through the head and handle of the toothbrush assembly.

1 Claim, 4 Drawing Sheets

HYDRO TOOTHBRUSH

CROSS-REFERENCE TO RELATED APPLICATION

This application claims the benefit of priority of U.S. provisional application No. 62/263,155, filed 4 Dec. 2015, the contents of which are herein incorporated by reference.

BACKGROUND OF THE INVENTION

The present invention relates to dental hygiene and, more particularly, to a toothbrush assembly for rinsing and cleaning a user's mouth by urging streams of water therethrough to remove plaque and food debris on and between teeth as well as below the gum line.

When using a standard toothbrush to remove plaque from teeth and to clean gum lines, most people assume they are using the toothbrush correctly as they have been using it since their youth. However, users of toothbrushes frequently suffer from gingivitis and gum disease because of bacteria build-up that their brushing does not remove.

As can be seen, there is a need for a water toothbrush assembly adapted to force streams water through the toothbrush to remove the plaque build-up, wherein hot water can be used to clean the teeth and below and between the gum lines.

SUMMARY OF THE INVENTION

In one aspect of the present invention, a water propulsion toothbrush assembly includes a head extending from a distal end to a proximal end along a longitudinal axis; a brush surface provided by the head, wherein the brush surface is generally oriented transverse relative to the longitudinal axis; an inner ring of spaced apart bristles bunches extending perpendicularly from the brush surface; an outer ring of spaced apart soft bristles bunches extending perpendicularly from the brush surface; and a plurality of spaced apart outlet apertures disposed between the inner and outer rings, wherein the plurality of spaced apart outlet apertures is fluidly communicated with a water source.

In another aspect of the present invention, the water propulsion toothbrush assembly includes a head extending from a distal end to a proximal end along a longitudinal axis; a brush surface provided by the head, wherein the brush surface is generally oriented transverse relative to the longitudinal axis; an inner ring of spaced apart bristles bunches extending perpendicularly from the brush surface; an outer ring of spaced apart soft rubber bristles bunches extending perpendicularly from the brush surface; a plurality of spaced apart outlet apertures disposed between the inner and outer rings, wherein the plurality of spaced apart outlet apertures is fluidly communicated with a water source, wherein at least two of the plurality of spaced apart outlet apertures each abut two soft rubber bristles bunches and two convention bristle bunches; a head vein extending along an interior space from the distal end so as to fluidly communicate the plurality of spaced apart outlet apertures thereto; a handle extending between a first and a second end, wherein the first end is coupled to the distal end, and wherein the handle provides a handle vein extending its length along an interior space thereof so to fluidly communicate the head vein to the second end; and a feed tube coupled to the second end so as to extend to a connector configured to removably attached to the water source.

These and other features, aspects and advantages of the present invention will become better understood with reference to the following drawings, description and claims.

DETAILED DESCRIPTION OF THE INVENTION

Figure 1:
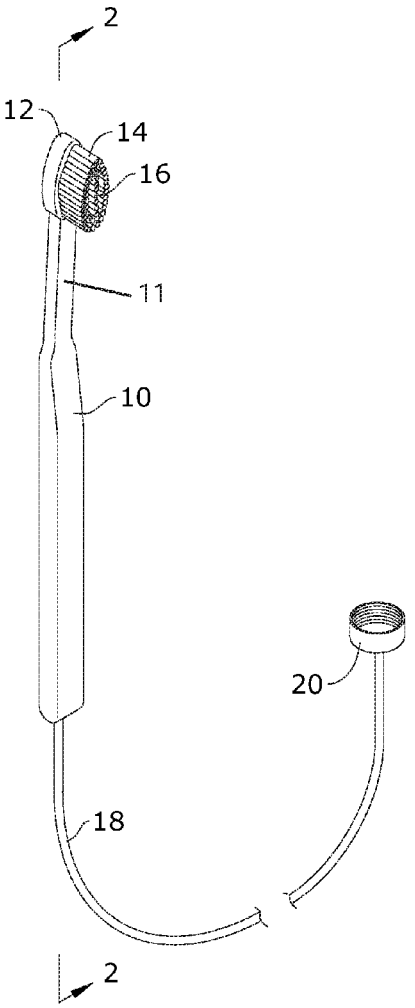
FIG. 1 is a perspective view of an exemplary embodiment of the present invention.
Figure 2:
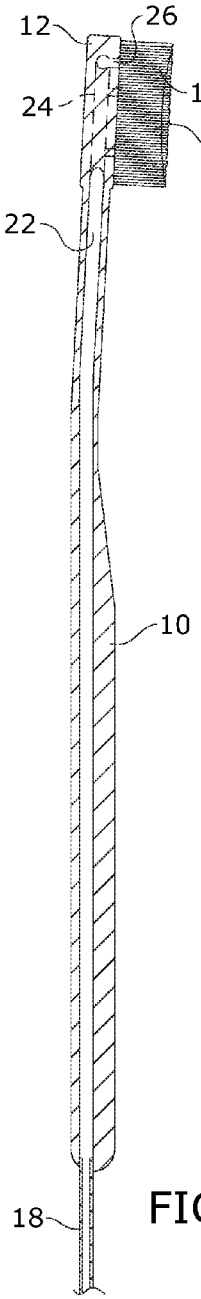
FIG. 2 is section view of an exemplary embodiment of the present invention, taken along line 2-2 of FIG. 1.
Figure 3:
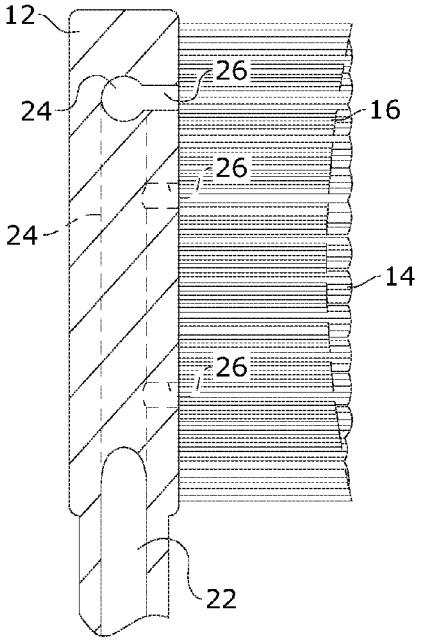
FIG. 3 is a detail section view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a water propulsion toothbrush assembly for rinsing and cleaning a user's mouth by urging streams of water therethrough to remove plaque and food debris on and between teeth as well as below the gum line during brushing. The toothbrush assembly includes a handle connected to a head, wherein the head provides a plurality of outlet apertures nested between conventional and novel soft bristles along the brush surface thereof. The plurality of outlet apertures is fluidly connected to a water source by way of veins extending through the head and handle of the toothbrush assembly.

Referring to FIGS. 1 through 7, the present invention may include a water toothbrush assembly for spraying water into a user's mouth to remove the plaque build-up on the user's teeth as well as cleaning below and between their gums. The toothbrush assembly provides an elongated handle 10 and a head 12 interconnected thereto, in certain embodiments by a neck portion 11. The head 12 provides a brush surface 13 providing a plurality of soft bristles 14, conventional bristles 16 and a plurality of outlet apertures 26 oriented generally transversely to the brush surface 13.

Figure 4:
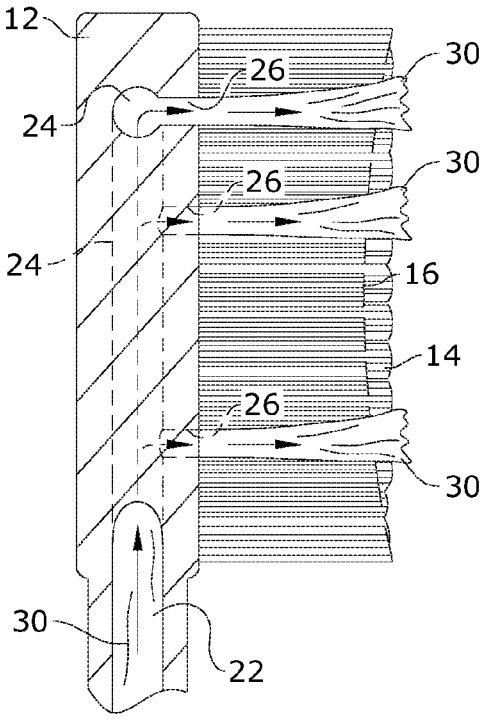
FIG. 4 is a detail section view of an exemplary embodiment of the present invention, demonstrating the movement of water.

The handle 10 extends from a distal end to a proximal end to where the neck portions 11 and/or head 12 are connected. A handle vein 22 extends through and interior space of the handle 10 so as to fluidly communicate the distal end thereof with a head vein 24 extending through an interior space of the head 12, as illustrated in FIG. 4. A feed tube 18 may be attached to the distal end of the handle 10 so as to be fluidly connected to the handle vein 22. The feed tube 18 extends from said distal end to a connector 20. The connector 20 may be adapted and dimensioned to removably attach to a water source 32 (such as a faucet). In certain embodiments, an adaptor 28 may be provided to facilitate an adjustable attachment to the water source 32, for example by providing a threaded ring. The feed tube 18 may be dimensioned and adapted for delivering water 30 from the water source 32 to the plurality of outlet apertures 26 with sufficient force to remove plaque and food debris from teeth and the gum lines of a human user.

Figure 5:
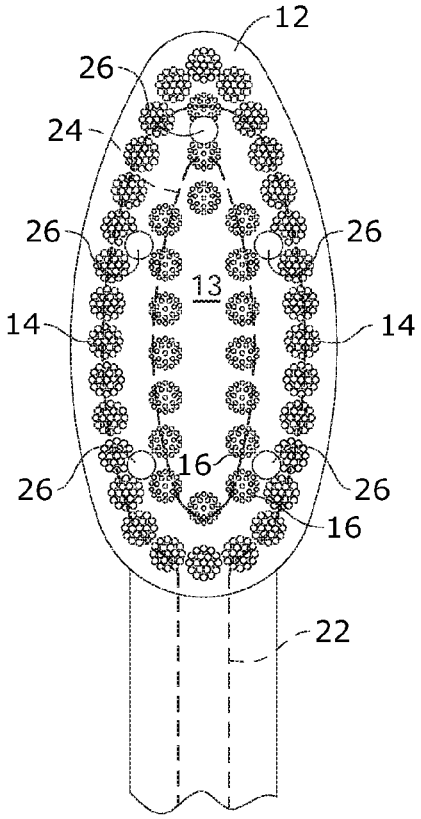
FIG. 5 is a detail front view of an exemplary embodiment of the present invention.
Figure 6:
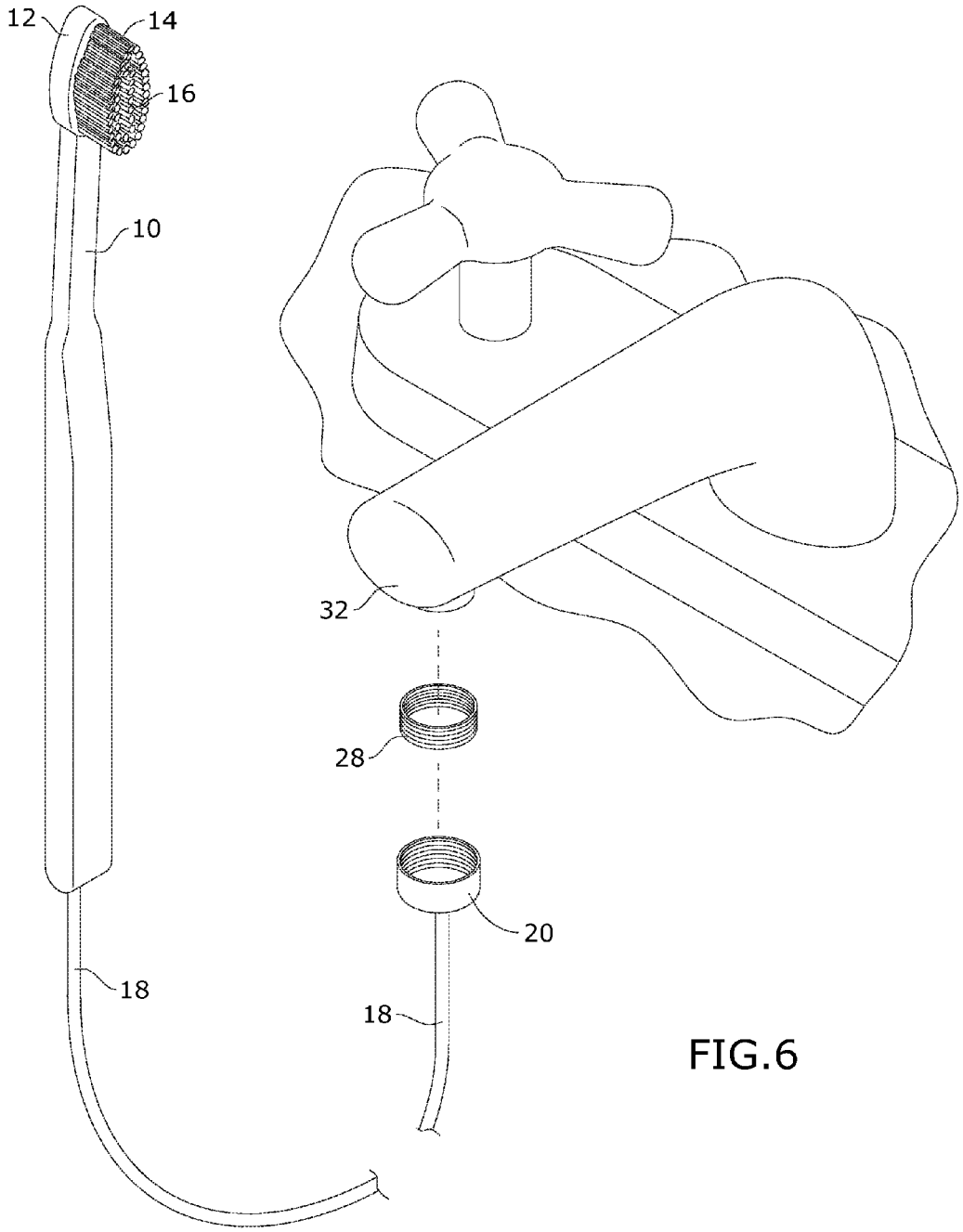
FIG. 6 is a perspective view of an exemplary embodiment of the present invention, demonstrating an attachment to a water source.
Figure 7:
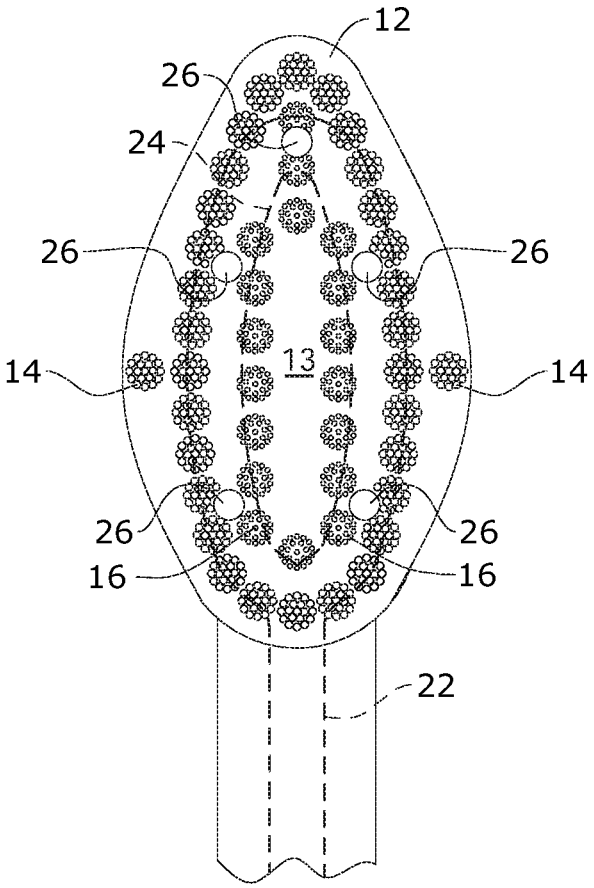
FIG. 7 is a detail front view of an exemplary embodiment of the present invention.

The head 12 may be substantially oval-shaped, as illustrated in FIG. 5. Though in an alternative embodiment, a midportion of the brush surface 13 may be squatter, as illustrated in FIG. 7. The brush surface 13 may provide an inner ring of spaced apart conventional bristle bunches 16, and an outer ring of spaced apart soft bristles bunches 14. Between the outer and inner rings, the plurality of outlet apertures 26 may be provided in a spaced apart manner, as illustrated in FIGS. 5 and 7. In the alternative embodiments, an additional set of soft bristles 14 may be disposed along the squatter midportion of the brush surface 13, as illustrated in FIG. 7. Each bunch of bristles (soft and conventional) are coupled to and extends outwardly from the brush surface 13. Some of the outlet apertures 26 may be vertically alighted and nested between two conventional bristle bunches 16 and two opposing soft bristle bunches 14. The soft bristles 14 may be made of soft rubber or the like.

A method of using the present invention may include the following. The water toothbrush assembly 100 disclosed above may be provided. A user may fluidly connect the plurality of outlet apertures 26 and the water source 32 by connecting the feed tube 18 to the latter. Thereby, the water 30 may be delivered through the feed tube 18 using the force of water pressure, so that the water 30 is sprayed or jetted between the nesting of conventional and soft bristle bunches 16 and 14 in conjunction with the user brushing their teeth, as illustrated in FIG. 4. Whereby the user may forcefully spray streams of hot water 30 on their teeth and along their gum lines, removing plaque build-up on the former as well as cleaning below and between the latter.

It should be understood, of course, that the foregoing relates to exemplary embodiments of the invention and that modifications may be made without departing from the spirit and scope of the invention as set forth in the following claims.

What is claimed is:

1. A toothbrush assembly, comprising:

a head extending from a distal end to a proximal end along a longitudinal axis;

a brush surface provided by the head, wherein the brush surface is generally oriented transverse relative to the longitudinal axis; the brush surface having a squat oval shape having proximal and distal ends aligned on the longitudinal axis and bulbous side portions positioned on opposite sides of the longitudinal axis and approximately midway between the proximal and distal ends;

an inner ring of spaced apart conventional bristles bunches extending perpendicularly from the brush surface;

an outer ring of spaced apart soft rubber bristles bunches extending perpendicularly from the brush surface wherein the soft rubber bristle bunches are softer than the conventional bristle bunches and wherein the outer ring of soft rubber bristle bunches surrounds the inner ring of conventional bristle bunches;

only one single bunch of soft rubber bristles adjacent a perimeter of the brush surface at each bulbous side portion;

a plurality of spaced apart outlet apertures disposed between the inner and outer rings, wherein the plurality of spaced apart outlet apertures is fluidly communicated with a water source, wherein at least two of the plurality of spaced apart outlet apertures each are adjacent two of the soft rubber bristles bunches and two of the convention bristle bunches;

a head vein extending along an interior space from the distal end so as to fluidly communicate the plurality of spaced apart outlet apertures;

a handle extending between a first and a second end, wherein the first end is coupled to the distal end, and wherein the handle provides a handle vein extending its length along an interior space thereof so to fluidly communicate the head vein to the second end; and a feed tube coupled to the second end so as to extend to a connector configured to removably attached to the water source such that water from the water source may flow through the feed tube, handle vein and head vein and out of the outlet apertures.

* * * * *